US009138624B2

(12) United States Patent
Maugham

(10) Patent No.: US 9,138,624 B2
(45) Date of Patent: Sep. 22, 2015

(54) GOLF GLOVE MAGNETIC ATTACHMENT ADAPTOR

(71) Applicant: Christopher Matthew Maugham, Lake Worth, FL (US)

(72) Inventor: Christopher Matthew Maugham, Lake Worth, FL (US)

( * ) Notice: Subject to any disclaimer, the term of this patent is extended or adjusted under 35 U.S.C. 154(b) by 0 days.

(21) Appl. No.: 14/102,547

(22) Filed: Dec. 11, 2013

(65) Prior Publication Data

US 2014/0189983 A1 Jul. 10, 2014

Related U.S. Application Data

(60) Provisional application No. 61/750,456, filed on Jan. 9, 2013.

(51) Int. Cl.

| | |
|---|---|
| ***A63B 57/00*** | (2015.01) |
| ***A44B 17/00*** | (2006.01) |
| ***A41D 19/00*** | (2006.01) |
| ***A63B 71/14*** | (2006.01) |

(52) U.S. Cl.

CPC ..... *A63B 57/0075* (2013.01); *A41D 19/0024* (2013.01); *A44B 17/0041* (2013.01); *A63B 71/146* (2013.01); *A44D 2203/00* (2013.01); *A63B 2209/08* (2013.01); *Y10T 24/32* (2015.01)

(58) Field of Classification Search

CPC ..... A41F 1/002; A41F 1/004; A41F 1/06; A44D 2203/00; A63B 2209/08; A63B 57/0075; A63B 71/146; A45C 13/1069; A41B 1/10; A41D 19/0048; A41D 25/003; A41D 19/0024; A42B 3/08; A44B 1/28; A44B 5/02; A44B 6/00; A44B 99/005; A44B 17/0041; A44C 5/2042; A44C 5/2061; Y10T 24/32

USPC ..... 24/303

See application file for complete search history.

(56) References Cited

U.S. PATENT DOCUMENTS

| | | | | | |
|---|---|---|---|---|---|
| 3,141,216 | A * | 7/1964 | Haskell | 24/303 |
| 3,372,443 | A * | 3/1968 | Daddona, Jr. | 24/303 |
| 3,923,215 | A * | 12/1975 | Suzuki | 224/183 |
| 4,021,891 | A * | 5/1977 | Morita | 24/303 |
| 4,530,500 | A * | 7/1985 | Kaymen | 473/406 |
| 4,908,879 | A * | 3/1990 | Roderman | 2/161.2 |
| 5,987,715 | A * | 11/1999 | Khon | 24/303 |
| 6,052,828 | A * | 4/2000 | Widdemer | 2/161.2 |
| 6,170,088 | B1 * | 1/2001 | Tate | 2/209.13 |
| 6,170,131 | B1 * | 1/2001 | Shin | 24/303 |
| 6,182,336 | B1 * | 2/2001 | Bauer | 24/303 |
| 6,422,955 | B1 * | 7/2002 | Lopez | 473/406 |
| 6,519,776 | B1 * | 2/2003 | Davenport et al. | 2/161.2 |
| 6,578,746 | B1 * | 6/2003 | Greves | 473/406 |
| 7,373,696 | B2 * | 5/2008 | Schoening et al. | 24/66.1 |

(Continued)

*Primary Examiner* — Robert J Sandy
*Assistant Examiner* — David Upchurch

(57) ABSTRACT

A golf glove magnetic attachment adaptor has a magnetic body and a male snap stud. The magnetic body includes a magnet and a magnet casing; the magnet casing having an end wall, a lateral wall, and an end cap. The magnet is positioned within the magnet casing and allows the golf glove magnetic attachment adaptor to be attached to any substantially ferrous metal object. The male snap stud is centrally connected to the magnet casing opposite the magnet and allows the golf glove magnetic attachment adaptor to be attached to a female snap socket of a golf glove. In turn, the golf glove can be attached to any desired metal object. The golf glove magnetic attachment adaptor also functions as a ball marker when detached from the golf glove by depressing the male snap stud into the ground in order to anchor the magnetic body in place.

12 Claims, 10 Drawing Sheets

(56) References Cited

U.S. PATENT DOCUMENTS

| | | | | |
|---|---|---|---|---|
| 8,388,469 | B1 * | 3/2013 | Hawthorn et al. | 473/406 |
| 8,631,517 | B1 * | 1/2014 | Blakely | 2/266 |
| 2002/0095751 | A1 * | 7/2002 | Reiter | 24/303 |
| 2006/0150304 | A1 * | 7/2006 | Bentz | 2/421 |
| 2006/0236509 | A1 * | 10/2006 | Ausman | 24/303 |
| 2007/0113383 | A1 * | 5/2007 | Grunberger et al. | 24/303 |
| 2007/0124898 | A1 * | 6/2007 | Clark | 24/303 |
| 2008/0047111 | A1 * | 2/2008 | Garber | 24/303 |
| 2009/0133229 | A1 * | 5/2009 | Kogen | 24/303 |
| 2010/0263173 | A1 * | 10/2010 | Clarke et al. | 24/303 |
| 2011/0265289 | A1 * | 11/2011 | Wu | 24/303 |
| 2012/0124786 | A1 * | 5/2012 | Fiedler | 24/303 |
| 2012/0174346 | A1 * | 7/2012 | Fildan et al. | 24/303 |

* cited by examiner

GOLF GLOVE MAGNETIC ATTACHMENT ADAPTOR

The current application claims a priority to the U.S. Provisional Patent application Ser. No. 61/750,456 filed on Jan. 9, 2013.

FIELD OF THE INVENTION

The present invention relates generally to golf equipment. More specifically, the present invention is a small magnetic ball marker that is designed to snap into the female snap socket present on almost all golf gloves available on the market today. Furthermore, the present invention allows the attached golf glove to be hung from a metal surface.

BACKGROUND OF THE INVENTION

Golfing is a recreational sport that is well known in the modern world as a weekend pastime for the working man. The game of golf involves hitting a small ball with a club, with the objective of causing that ball to enter a small cup which is located on the green at the end of a fairway. Together each fairway and green is referred to as a hole, each hole constituting a region of varying terrain having certain unique characteristics, such as changes in elevation, sand traps, water hazards. etc. Because of this, each hole presents a unique challenge to the golfer, whose goal is to hit the golf ball into the cup in as few hits as possible. Hitting the ball into the cup at all, let alone minimizing the number of hits it takes is an act that requires great skill on the part of the golfer. Playing the game of golf also requires a lot of equipment including a number of golf clubs, golf balls, and a bag to carry the clubs and balls. Some additional equipment that is often used by golfers includes golf gloves and ball markers. A golf glove is a glove that is worn by the player and comprises materials that help to drastically improve the player's grip on the golf club. The grip achieved on the golf club when wearing the golf glove is far superior to the grip achieved by a player's bare hands, especially as that player's hands may be sweaty, and thus are more prone to slipping along the grip of the golf club. Almost all golf gloves also possess a female snap socket that allows the player to attach a ball marker of their choice to the glove. Ball markers are used to allow the player to mark the position of their ball on the green, such that the ball may be retrieved for cleaning or to un-obstruct the path between a subsequent player's ball and the cup.

Wearing a golf glove is recommended when playing the game of golf due to the advantages it offers as mentioned above. Unfortunately, despite the advantages, wearing a golf glove while playing golf does come with some inconveniences. For starters, the glove itself must be stored, either in the player's pocket or in a zipper pocket of their golf bag. Continuously returning the glove to storage and retrieving the glove for use can become tiresome and annoying for some golfers, especially when they must focus on a particularly difficult shot. Additionally, the locations in which golf gloves are most commonly stored are not conducive to the glove airing out and becoming dry again. This is important to note, as the golf glove may easily lose its effectiveness if the golf glove becomes too sweaty as may happen on hotter days.

Therefore it is an object of the present invention to solve the above mentioned issue by taking advantage of the female snap socket present on most golf gloves. The present invention is a golf glove magnetic attachment adaptor having a magnetic body and a male snap stud. The male snap stud allows the present invention to be attached to the female snap socket of a golf glove. The magnetic body then allows the present invention and the attached golf glove to be quickly and easily attached to and removed from any ferrous metal object, such as the frame of a golf cart or the shaft of a golf club. By being attached to these objects, the golf glove is more readily dried, thus improving the effectiveness of the golf glove, and is much easier to retrieve to be used by the player. This can greatly improve the effectiveness of the golf glove as the improved grip offered by the glove is maintained.

The present invention can also aid in minimizing any annoyance with the golf glove that could distract the player. It is a further object of the present invention to also function as a ball marker which can be removed from the glove and placed on the ground. The multirole nature of the present invention helps to minimize the amount of equipment that needs to be carried by the player.

DETAIL DESCRIPTIONS OF THE INVENTION

All illustrations of the drawings are for the purpose of describing selected versions of the present invention and are not intended to limit the scope of the present invention.

The present invention is a golf glove magnetic attachment adaptor that can either be used as a golf ball marker or to suspend an attached golf glove 6. The golf glove magnetic attachment adaptor comprises a magnetic body 1 and a male snap stud 4. Both the magnetic body 1 and the male snap stud 4 provide dual functionality to the present invention. The magnetic body 1 allows the present invention to be attached to any object having a substantially ferrous metal composition, in addition to serving as a ball marker when the present invention is detached from the golf glove 6. The male snap stud 4 provides a means of connection to the golf glove 6 and serves as an anchor to hold the magnetic body 1 in place when the present invention is used as a ball marker.

The male snap stud 4 is a protrusion that is properly shaped such that it may interface with a female snap socket 5. The male snap stud 4 can be constructed from any number of materials including, but not limited to, machined metals, injection molded plastics, and stamped sheet metal. In the preferred embodiment of the present invention, the female snap socket 5 is connected to a golf glove 6, depicted in FIG. 13, as is common with almost all golf gloves available on the current market. In reference to FIG. 14, when the present invention is attached to the golf glove 6, the male snap stud 4 engages the female snap socket 5. The mechanical bond between the male snap stud 4 and the female snap socket 5 keeps the present invention attached to the golf glove 6, while still allowing the present invention to be removed from the golf glove 6 and used as a ball marker as needed. It is also possible for the female snap socket 5 to be connected to any other golf accessories, such as a hat or towel.

Figure 1:
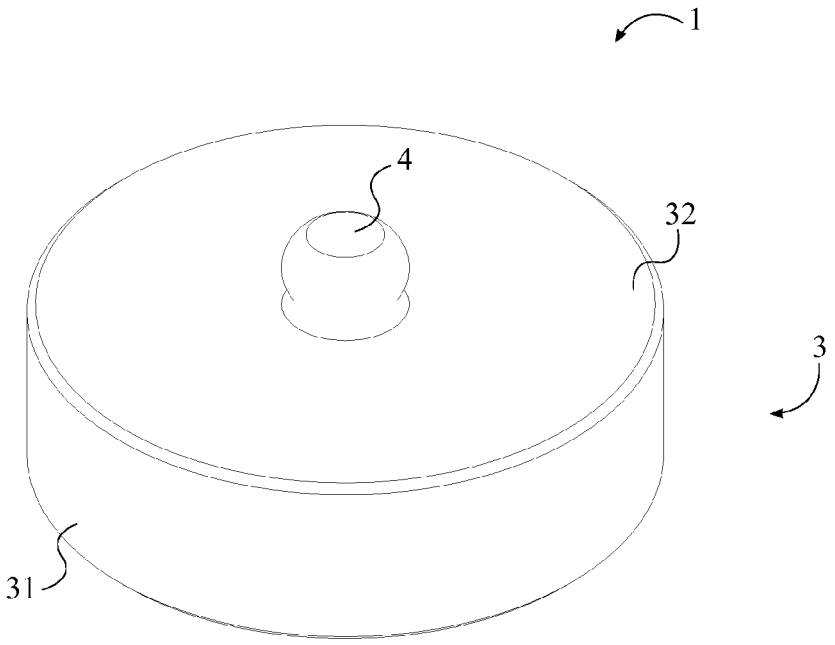
FIG. 1 is a perspective view of the present invention.
Figure 13:
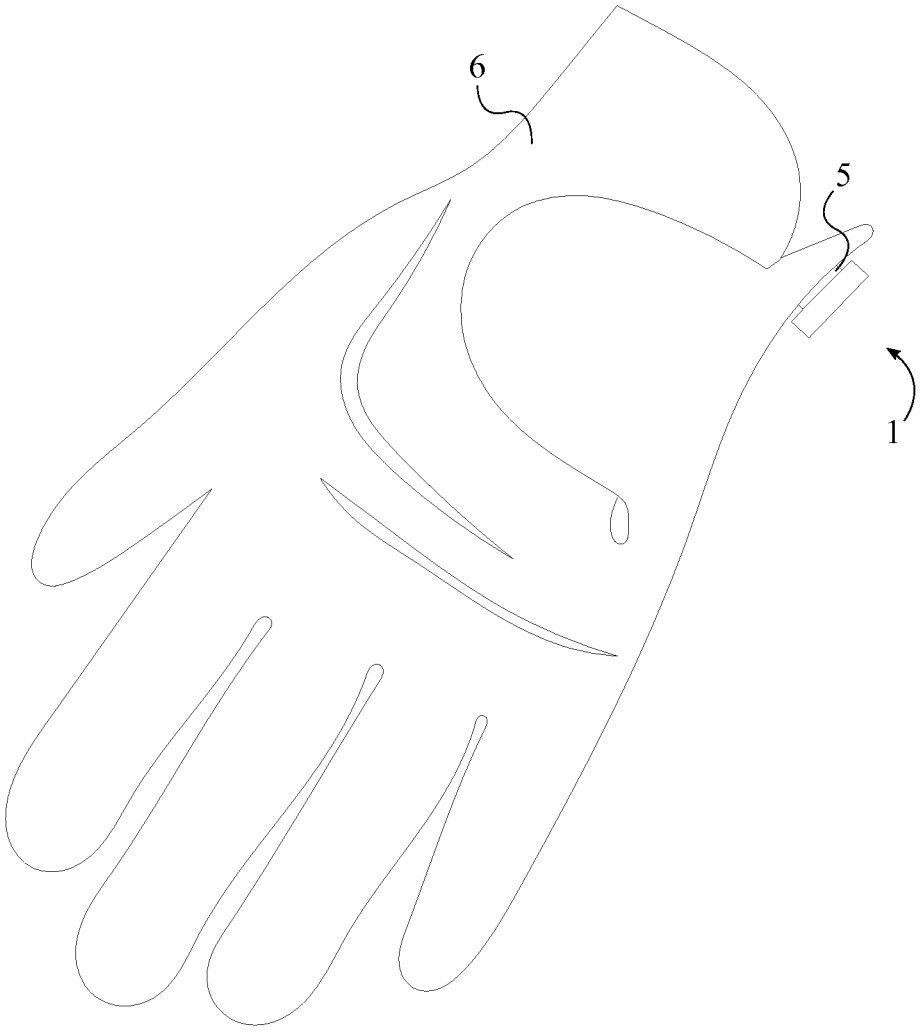
FIG. 13 is perspective view of the present invention attached to a golf glove.
Figure 14:
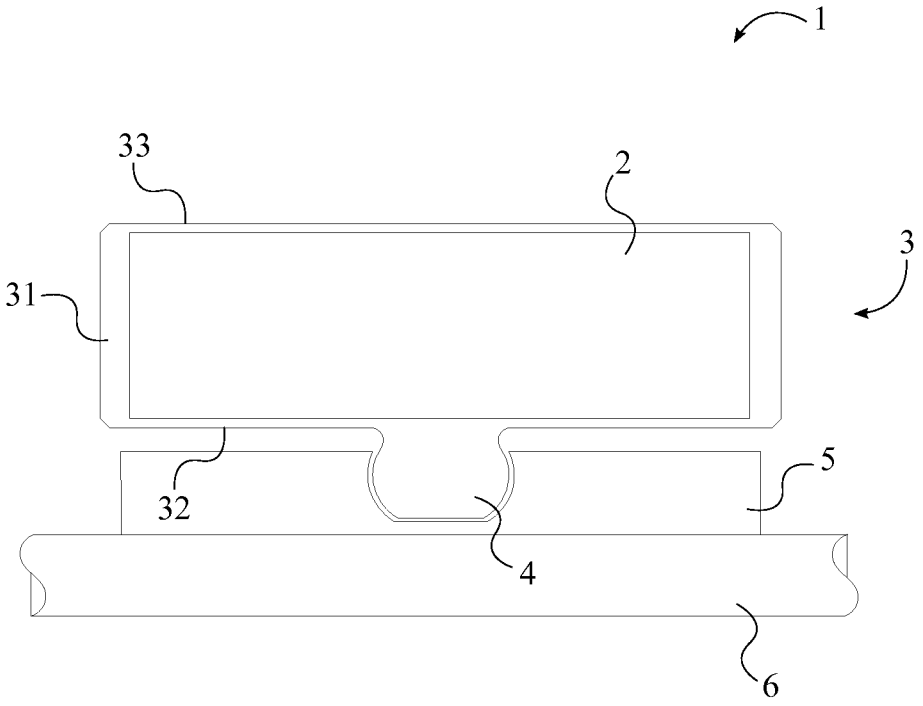
FIG. 14 is a zoomed sectional view thereof.

In reference to FIG. 1, the male snap stud 4 is adjacently connected to one end of the magnetic body 1, such that the magnetic body 1 lies substantially flat against the golf glove 6 when the present invention is attached to the golf glove 6, as shown in FIG. 13. Ideally, the male snap stud 4 is centrally positioned on the magnetic body 1 to provide optimal stability when depressed into the ground and to ensure proper alignment of the present invention (i.e. the present invention remains the same distance from the hole even when rotated about the male snap stud 4). However, it is possible for the male snap stud 4 to be positioned anywhere about the end surface of the magnetic body 1.

In the preferred embodiment of the present invention, the magnetic body 1 is circular, though this does not necessarily need to be the shape of the magnetic body 1. The magnetic body 1 may be rectangular, polygonal, or any other shape as desired by the manufacturer. The magnetic body 1 is of appropriate size to fit on the golf glove 6 and to serve as a ball marker when the need arises; both the length and the height of the magnetic body 1 being greater than the height of the magnetic body 1, such that the magnetic body 1 is substantially thin.

Figure 3:
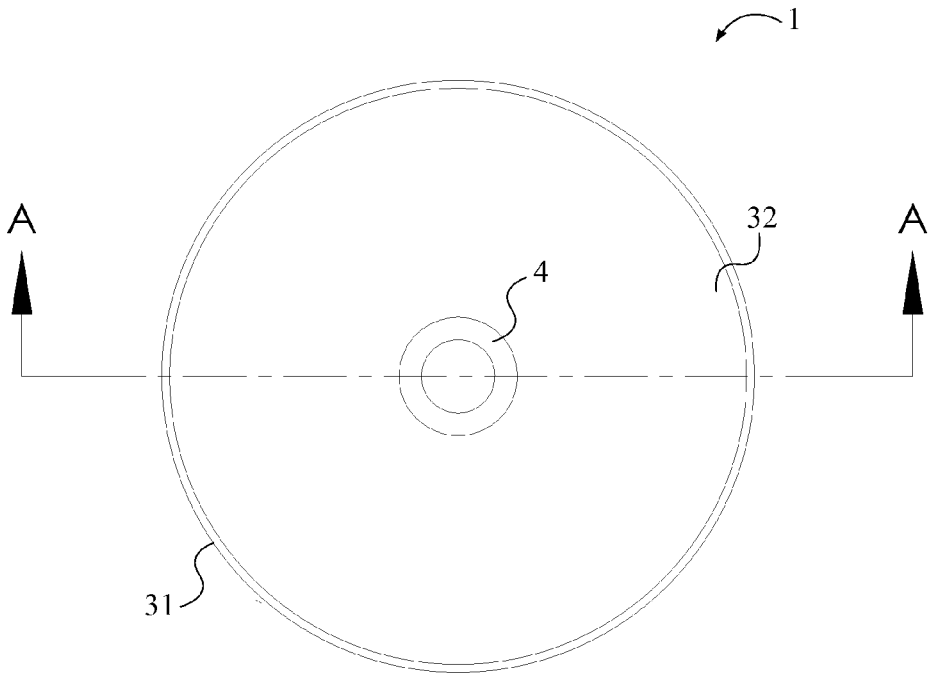
FIG. 3 is a top plan view of the present invention showing a line of intersection.
Figure 4:
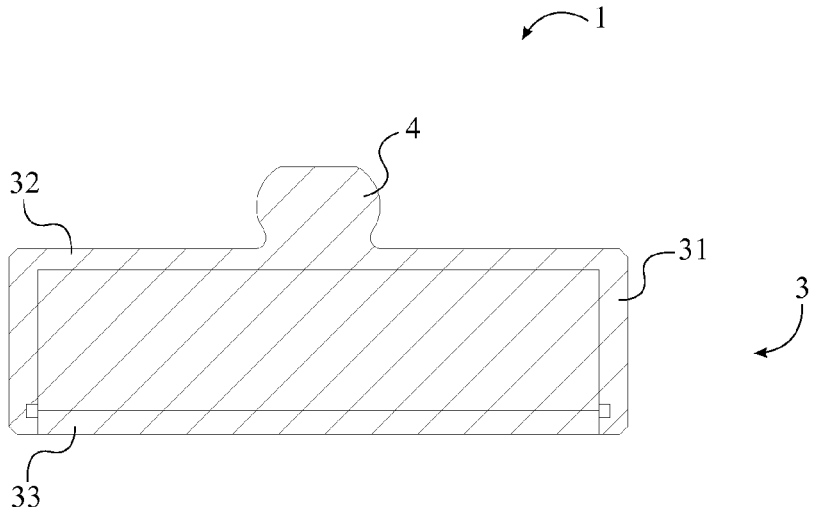
FIG. 4 is a cross sectional view thereof.
Figure 5:
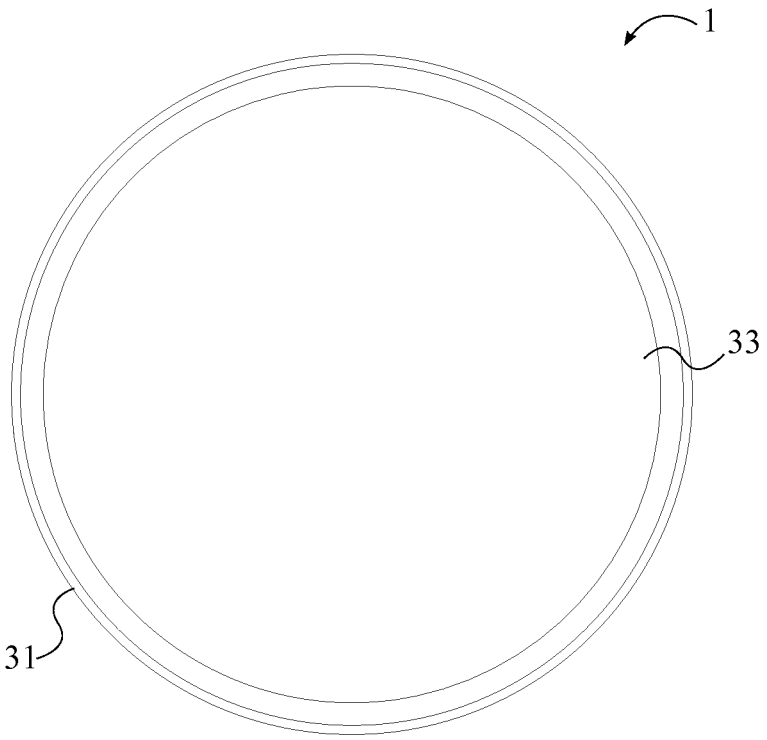
FIG. 5 is a bottom plan view of the present invention.
Figure 6:
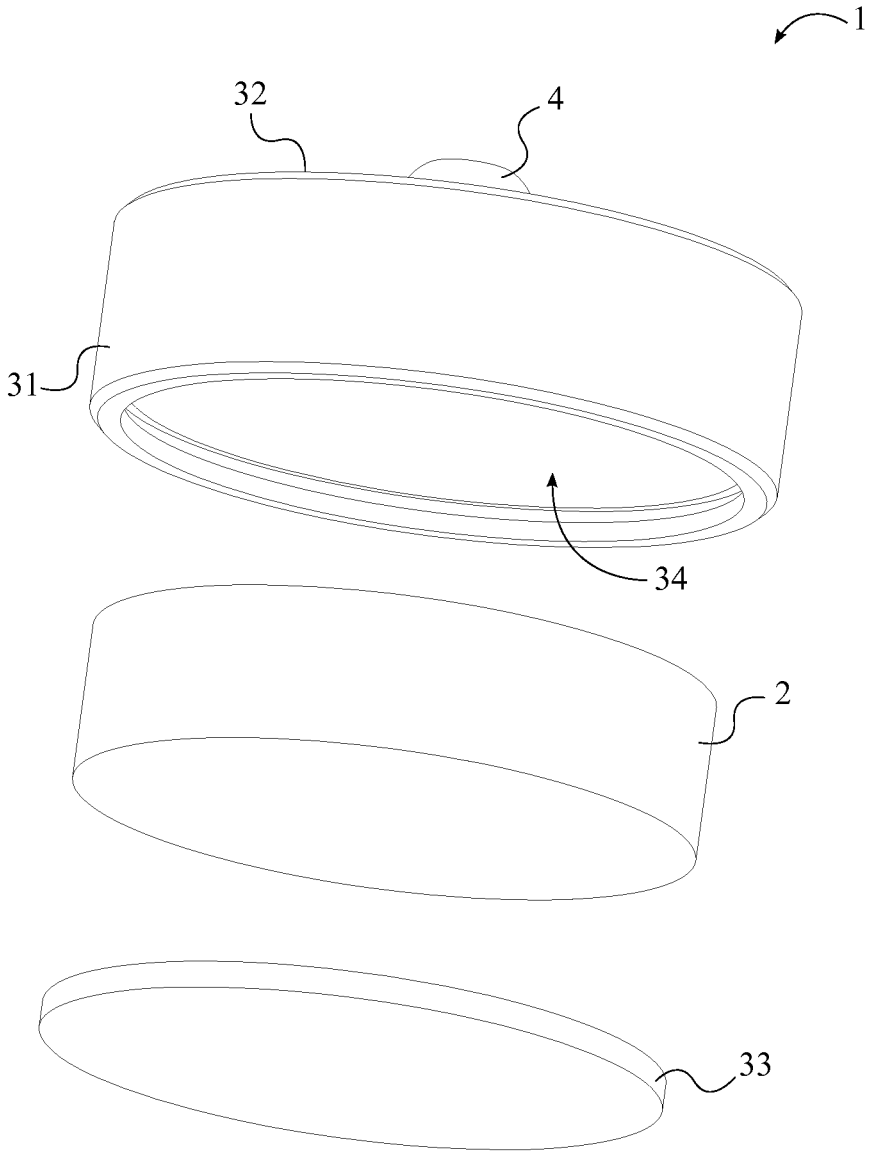
FIG. 6 is an exploded perspective view of the present invention.

In reference to FIG. 3-4, the magnetic body 1 comprises a magnet 2 and a magnet casing 3; the magnet 2 being retained by the magnet casing 3. Similar to the male snap stud 4, the magnet casing 3 can be constructed from any number of materials including, but not limited to, machined metals, injection molded plastics, and stamped sheet metal. The magnet casing 3 comprises a lateral wall 31, an end wall 32, and an end cap 33. Both the male snap stud 4 and the lateral wall 31 are connected to the end wall 32; the male snap stud 4 being centrally positioned on the end wall 32 and the lateral wall 31 being perimetrically connected to the end wall 32 opposite the male snap stud 4. Together, the lateral wall 31 and the end wall 32 delineate a cavity 34 into which the magnet 2 is positioned, as shown in FIG. 6. As such, the cavity 34 must be sufficient in diameter and depth to allow the magnet 2 to be inserted into the magnet casing 3. The magnet casing 3 may be circular, rectangular, polygonal, or any other shape as desired by the manufacturer.

The magnet 2 of the present invention may be any type of magnet 2 that attaches to ferrous metals through magnet attraction. The magnet 2 must be small enough to fit within the cavity 34 of the magnet casing 3; this is the only constraint upon the dimensions of the magnet 2. Additionally, much like the magnet casing 3, the magnet 2 may be any of a number of different shapes including circles, rectangles, and other polygons. The purpose of the magnet 2 is to provide a means for the present invention, as well as the attached golf glove 6, to be attached to any ferrous metal available to the player such that the golf glove 6 is easily and conveniently stored. For example, the present invention and the attached golf glove 6 can be hung from a golf cart, golf club, etc.

As the present invention is intended to stay with the golf glove 6 unless the player wishes to use the present invention as a ball marker, one constraint is placed upon the magnet 2. The constraint being that the force of magnetic attraction between the magnet 2 and the substantially ferrous metal object to which the magnet 2 is attracted must not exceed the force required to separate the mechanical bond between the male snap stud 4 and the female snap socket 5. Thus, the present invention remains attached to the golf glove 6 even when the golf glove 6 is pulled off of the substantially ferrous metal object to which the present invention was attached.

Figure 2:
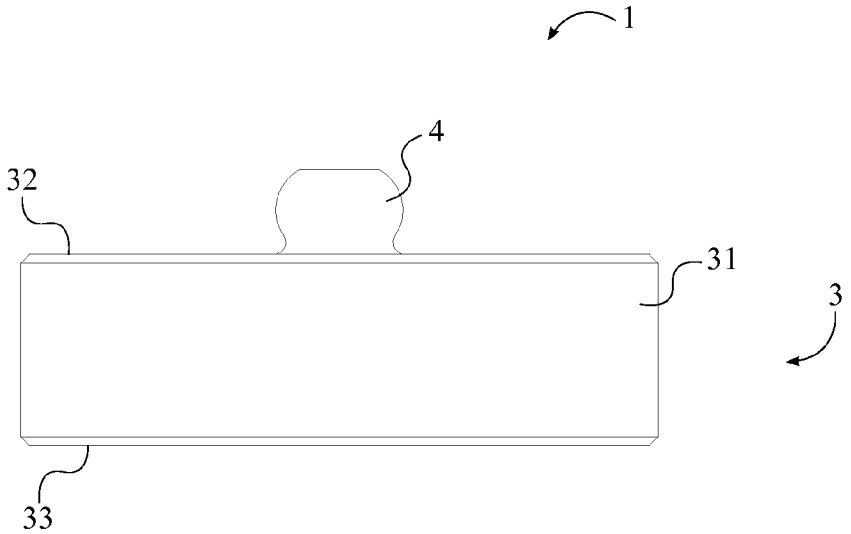
FIG. 2 is a front elevational view of the present invention.
Figure 7:
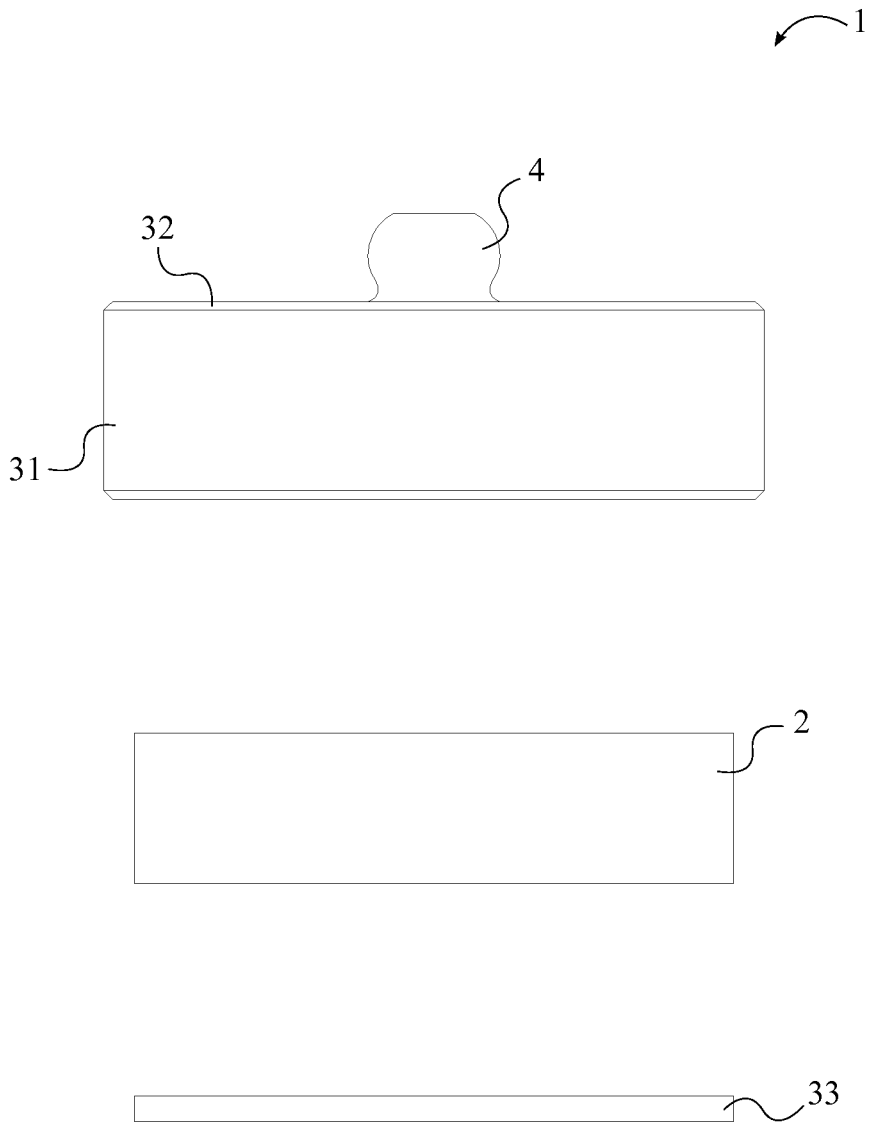
FIG. 7 is an exploded front view of the present invention.

In the preferred embodiment of the present invention, the male snap stud 4, the lateral wall 31, and the end wall 32 are manufactured as a single piece of material, as shown in FIG. 7, and the cavity 34 is then drilled out of the single piece of material. The magnet 2 is placed within the cavity 34 and the end cap 33 is perimetrically connected to the lateral wall 31 opposite the end wall 32, thus sealing the magnet 2 within the cavity 34, as depicted in FIG. 2. The end cap 33 may be constructed from the same material as the male snap stud 4, the lateral wall 31, and the end wall 32, or from any other material. For example, in a prototype of the present invention, the height of the magnet 2 was less than the depth of the cavity 34, resulting in a gap between the magnet 2 and the edge of the lateral wall 31 opposite the end wall 32. The end cap 33 was created by filling the gap left in the cavity 34 with epoxy and then sanding the epoxy down such that the epoxy was flush with the bottom surface of the lateral wall 31. Alternatively, the end cap 33 may be soldered, welded, or otherwise adhered in place to keep the magnet 2 contained within the magnet casing 3.

There are other methods of manufacturing by which the present invention may be created so long as the basic structures necessary for function of the present invention are properly formed. These alternatives in manufacturing the present invention are hereafter described as alternative embodiments of the present invention.

Figure 8:
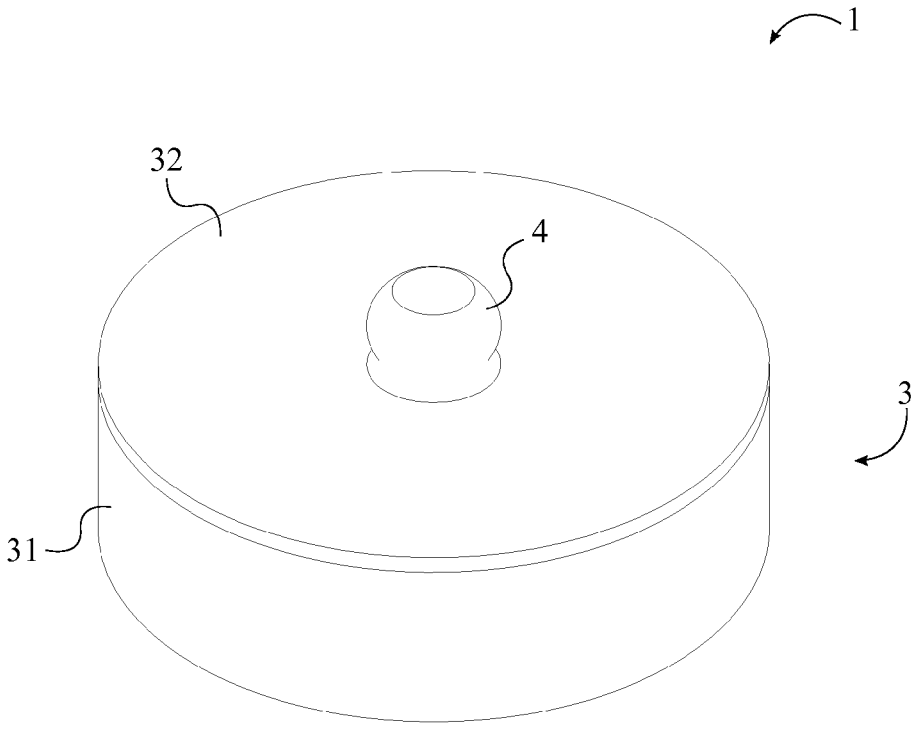
FIG. 8 is a perspective view of the present invention in a first alternative embodiment.
Figure 9:
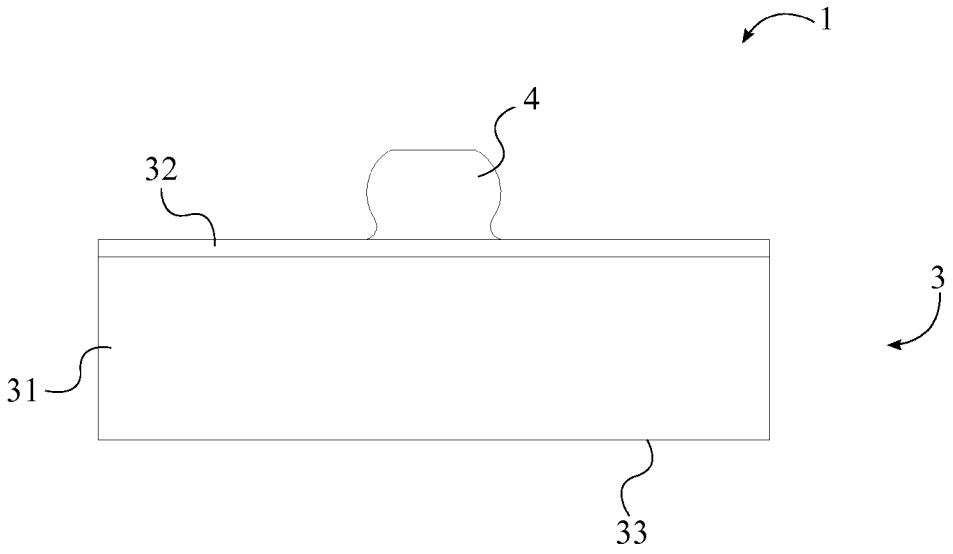
FIG. 9 is a front elevational view thereof.
Figure 10:
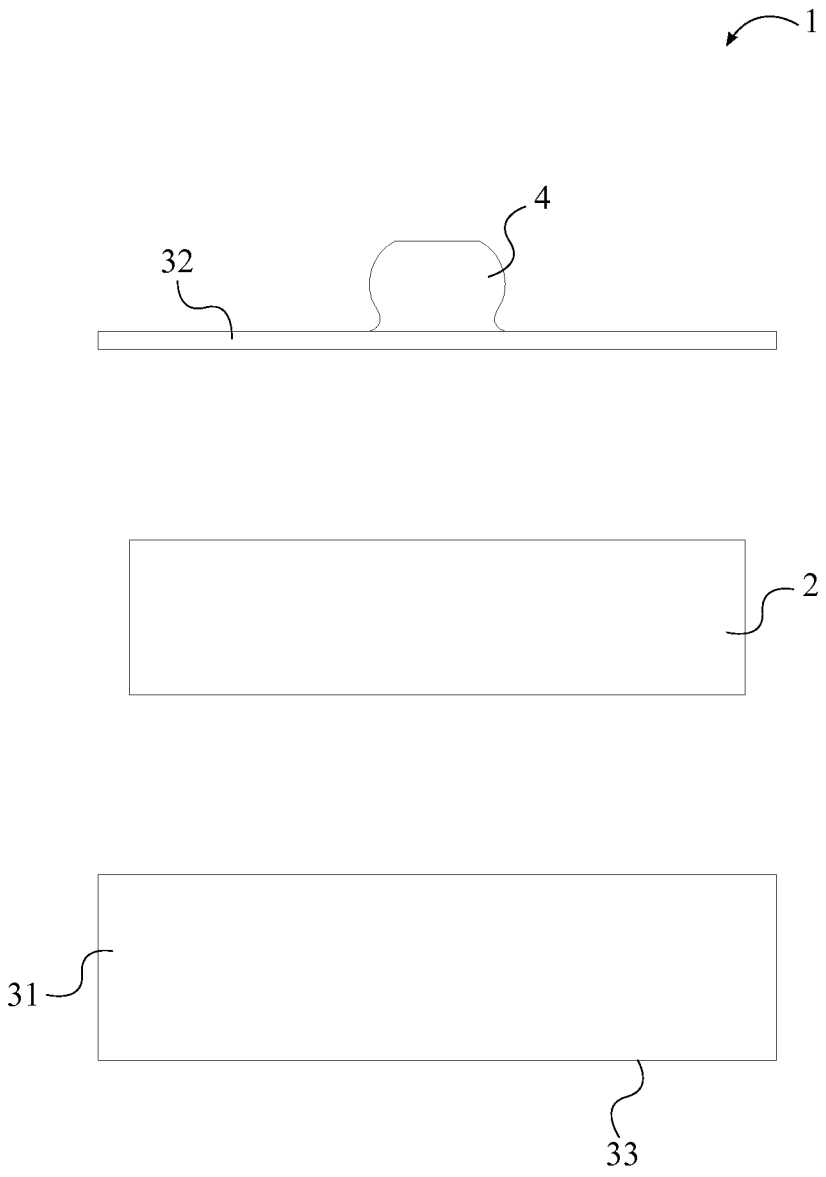
FIG. 10 is an exploded front view thereof.

In a first alternative embodiment of the present invention, the magnet casing 3 and the male snap stud 4 are formed using sheet metal and the manufacturing methods associated with the material. In reference to FIG. 8-10, in the first alternative embodiment, the end wall 32 of the magnet casing 3 and the male snap stud 4 are formed by stamping out a single top piece from the sheet metal. Similarly, the lateral wall 31 and the end cap 33 are formed by stamping out a single bottom piece from the sheet metal. The magnet 2 is then placed within the single bottom piece, and the single top piece is welded to the single bottom piece, thus forming the present invention.

Figure 11:
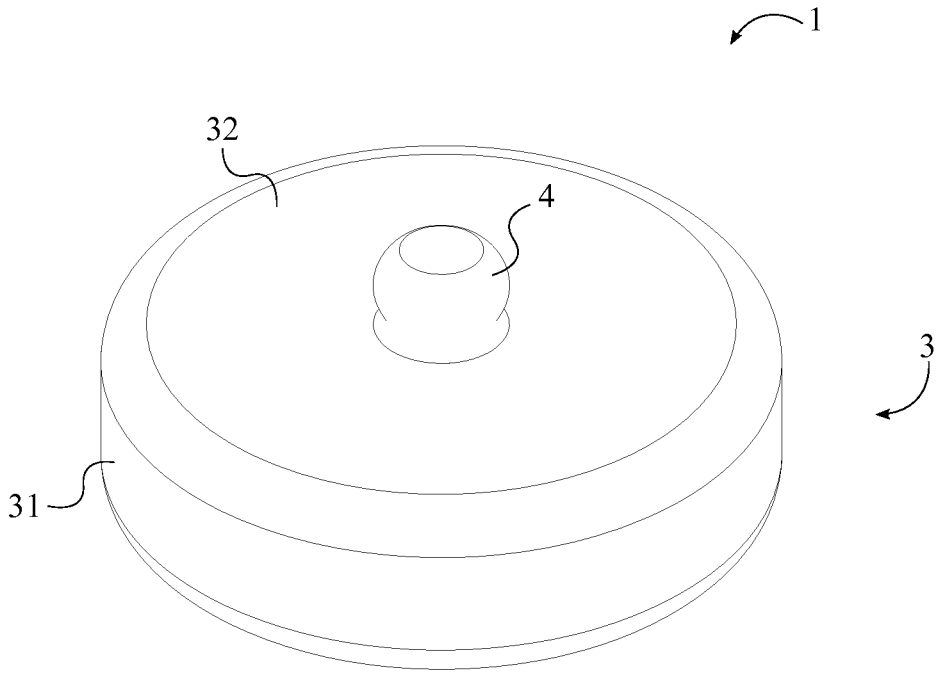
FIG. 11 is a perspective view of the present invention in a second alternative embodiment.
Figure 12:
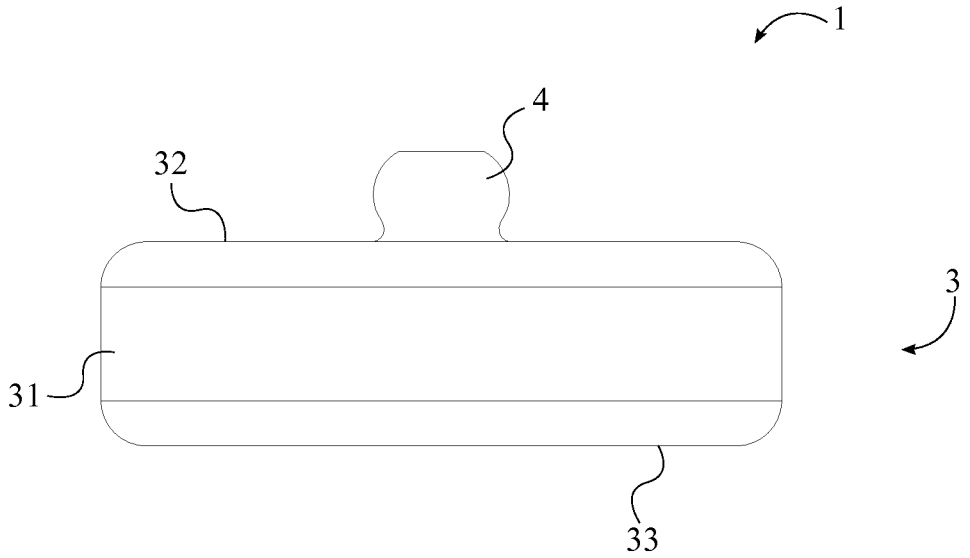
FIG. 12 is a front elevational view thereof.

In a second alternative embodiment of the present invention, the magnet casing 3 and the male snap stud 4 are manufactured through the use of injection molding of plastic. In the second alternative embodiment, a mold having the shape of the magnet casing 3 and the male snap stud 4 is used. The magnet 2 is placed within the mold and the mold is then injected with heated plastic. Once cooled, the hardened plastic fully encloses the magnet 2, thus forming the magnet casing 3 and the male snap stud 4, as shown in FIG. 11-12.

In a third alternative embodiment of the present invention, the magnet casing 3 is manufactured without the end cap 33. In order to retain the magnet 2 within the cavity 34, the magnet 2 is connected to the magnet casing 3 using an adhesive or epoxy. The magnet 2 can be connected to the lateral wall 31 or the end wall 32 or both. Additionally, the magnet 2 can be made to rest flush with the edge of the lateral wall 31 opposite the end wall 32, such that the present invention may readily be attached to the desired surface.

In a minimalist embodiment, the magnetic body 1 is a generally flat piece of ferromagnetic material, wherein the magnetic body 1 is in essence the magnet 2 without the magnet casing 3. In this way, the height of the magnetic body 1 may be significantly reduced in order to enhance the present invention's use as a ball marker. Additionally, this would reduce the size and weight of the present invention, thus making the present invention more desirable to the user as an attachment to the golf glove 6.

It is considered obvious that other manufacturing methods may exist which would be effective at creating the present invention. Any manufacturing method not mentioned here that is suitable for creation of the present invention may be utilized without departing from the scope and spirit of the present invention.

Although the invention has been explained in relation to its preferred embodiment, it is to be understood that many other possible modifications and variations can be made without departing from the spirit and scope of the invention as hereinafter claimed.

What is claimed is:

1. A golf glove magnetic assembly comprises:

a magnetic body, wherein the magnetic body can be attached to a substantially ferrous metal object through magnetic attraction;

a male snap stud comprising a bulbous protuberance and a flat top surface, wherein the male snap stud provides both a means of connection and a mainstay;

the male snap stud being adjacently connected to the magnetic body, wherein the male snap stud is used to anchor the magnetic body to the ground as a ball marker when depressed into the ground;

the magnetic body comprises a magnet and a magnet casing;

the magnet casing comprises a lateral wall and an end wall;

the male snap stud being connected to the end wall;

the lateral wall being perimetrically connected to the end wall opposite the male snap stud;

the lateral wall and the end wall delineating a cavity;

the magnet being positioned within the cavity;

the magnet being connected to the magnet casing;

the magnet casing further comprises an end cap;

the end cap being perimetrically connected to the lateral wall opposite the end wall, wherein the magnet is sealed within the magnet casing;

a golf glove comprising a female snap socket;

wherein the male snap stud is adapted to snap-fit into the female snap socket;

wherein the magnetic body is connected to the magnet casing by adhesive or epoxy; and wherein the male snap stud, the lateral wall and the end wall are integrally formed.

2. The golf glove magnetic attachment adaptor as claimed in claim 1, wherein the length of the magnetic body is greater than the height of the magnetic body.

3. The golf glove magnetic attachment adaptor as claimed in claim 1, wherein the width of the magnetic body is greater than the height of the magnetic body.

4. The golf glove magnetic attachment adaptor as claimed in claim 1 comprises:

the male snap stud being centrally positioned on the magnetic body.

5. A golf glove magnetic assembly comprises:

a magnetic body;

a male snap stud comprising a bulbous protuberance and a flat top surface;

the magnetic body comprises a magnet and a magnet casing;

the magnet casing comprises a lateral wall and an end wall;

the male snap stud being adjacently connected to the end wall;

the lateral wall being perimetrically connected to the end wall opposite the male snap stud;

the lateral wall and the end wall delineating a cavity;

the magnet being positioned within the cavity;

the male snap stud being centrally positioned on the end wall;

the magnet being connected to the magnetic casing;

the magnetic casing further comprises an end cap;

the end cap being perimetrically connected to the lateral wall opposite the end wall, wherein the magnet is sealed within the magnet casing;

a golf glove comprising a female snap socket;

wherein the male snap stud is adapted to snap-fit into the female snap socket;

wherein the magnetic body is connected to the magnet casing by adhesive or epoxy; and wherein the male snap stud, the lateral wall and the end wall are integrally formed.

6. The golf glove magnetic attachment adaptor as claimed in claim 5, wherein the length of the magnetic body is greater than the height of the magnetic body.

7. The golf glove magnetic attachment adaptor as claimed in claim 5, wherein the width of the magnetic body is greater than the height of the magnetic body.

8. The golf glove magnetic attachment adaptor as claimed in claim 5 comprises:

the male snap stud being centrally positioned on the end wall.

9. The golf glove magnetic attachment adaptor as claimed in claim 5 comprises:

the magnet being connected to the magnetic casing.

10. A golf glove magnetic assembly comprises:

a magnetic body;

a male snap stud;

the magnetic body comprises a magnet and a magnet casing;

the magnet casing comprises a lateral wall, an end wall, and an end cap;

the male snap stud being adjacently connected to the end wall;

the lateral wall being perimetrically connected to the end wall opposite the male snap stud;

the lateral wall and the end wall delineating a cavity;

the magnet being positioned within the cavity; and the end cap being perimetrically connected to the lateral wall opposite the end wall, wherein the magnet is sealed within the magnet casing;

the male snap stud being centrally positioned on the end wall;

a golf glove comprising a female snap socket;

wherein the male snap stud is adapted to snap-fit into the female snap socket;

wherein the magnetic body is connected to the magnet casing by adhesive or epoxy; and wherein the male snap stud, the lateral wall and the end wall are integrally formed.

11. The golf glove magnetic attachment adaptor as claimed in claim 10, wherein the length of the body is greater than the height of the body.

12. The golf glove magnetic attachment adaptor as claimed in claim 10, wherein the width of the magnetic body is greater than the height of the magnetic body.

* * * * *